US008091935B2

(12) United States Patent
Moyes

(10) Patent No.: US 8,091,935 B2
(45) Date of Patent: Jan. 10, 2012

(54) INTERNAL RELEASE CONNECTOR AND METHOD

(75) Inventor: Peter Barnes Moyes, Aberdeenshire (GB)

(73) Assignee: Baker Hughes Incorporated, Houston, TX (US)

( * ) Notice: Subject to any disclaimer, the term of this patent is extended or adjusted under 35 U.S.C. 154(b) by 12 days.

(21) Appl. No.: 12/648,727

(22) Filed: Dec. 29, 2009

(65) Prior Publication Data

US 2010/0096849 A1 Apr. 22, 2010

Related U.S. Application Data

(62) Division of application No. 11/491,671, filed on Jul. 24, 2006, now Pat. No. 7,661,726.

(30) Foreign Application Priority Data

Jul. 22, 2005 (GB) ..... 0515073.5

(51) Int. Cl.
*E21B 31/00* (2006.01)

(52) U.S. Cl. ..... 294/86.17; 166/301

(58) Field of Classification Search ..... 294/86.17, 294/86.18, 86.19, 86.2; 166/301, 377, 381, 166/322

See application file for complete search history.

(56) References Cited

U.S. PATENT DOCUMENTS

| | | | | |
|---|---|---|---|---|
| 3,039,794 | A | 6/1962 | De Cenzo | |
| 4,281,858 | A | 8/1981 | Bowyer | |
| 4,285,533 | A | 8/1981 | Silberman et al. | |
| 4,457,368 | A | 7/1984 | Knierimen et al. | |
| 4,488,596 | A | 12/1984 | Akkerman | |
| 4,616,721 | A | 10/1986 | Furse | |
| 5,580,114 | A | 12/1996 | Palmer | |
| 5,605,366 | A | 2/1997 | Beeman | |
| 5,778,979 | A | 7/1998 | Burleson et al. | |
| 5,791,712 | A | 8/1998 | Hawn | |
| 6,896,049 | B2 | 5/2005 | Moyes | |
| 7,090,005 | B2 | 8/2006 | Smith, Jr. et al. | |
| 7,661,726 | B2 * | 2/2010 | Moyes | 285/322 |
| 7,931,085 | B2 * | 4/2011 | Moyes | 166/301 |
| 8,002,036 | B2 * | 8/2011 | Moyes | 166/301 |
| 2009/0145594 | A1 * | 6/2009 | Slack | 166/85.5 |

OTHER PUBLICATIONS

Sand Control: Weight-Down Sand Control Completion Systems, Halliburton H05065, Jun. 2006. 4 pages.

(Continued)

*Primary Examiner* — Paul T Chin
(74) *Attorney, Agent, or Firm* — Cantor Colburn LLP

(57) ABSTRACT

A tubing connection release system. The system includes, a male connector having a profile at one end thereof and receptive to a tubular at the other end thereof, a female connector receptive to a tubular at one end thereof and receptive to the male connector at the other end thereof. The system further includes, a sleeve disposed radially inwardly of the female connector, and a collet having at least one deflectable collet finger disposed radially inwardly of the sleeve. The collet is biased to a position within the female connector whereat the at least one collet finger is supported against radially outward deflection. The collet is further movable by the push-in connector against the bias to a position where the at least one collet finger is radially outwardly unsupported such that the profiled end of the male connector is movable into engagement with the at least one collet finger.

15 Claims, 17 Drawing Sheets

OTHER PUBLICATIONS

Schlumberger, Tandem Packer, CoilTOOLS Catalog, date unknown. Retrieved online on Sep. 24, 2008 from: http://www.slb.com/media/services/coiled/tools/tandempacker.pdf.

Schlumberger, Model C and CL Compression Packers, CoilTOOLS Catalog, date unknown. Retrieved online on Sep. 24, 2008 from: http://www.slb.com/media/services/coiled/tools/modelcclcompressionpackers.pdf.

Inflatable Packers: Infaltable Straddle, Production and Annulus Casing Packers for Zonal Isolation in Critical Well Bore Applications, Weatherford, Copyright 2002. Brochure #612.00, pp. 1-12, 18, 19. Retrieved online on Sep. 24, 2008 from: http://www.weatherford.com/weatherford/groups/public/documents/general/wft003553.pdf.

* cited by examiner

INTERNAL RELEASE CONNECTOR AND METHOD

CROSS REFERENCE TO RELATED APPLICATIONS

This application claims priority to G.B. provisional application, 0515073.5, filed Jul. 22, 2005, the entire contents of which are incorporated herein by reference. This application claims priority to U.S. application Ser. No. 11/491,671, filed Jul. 24, 2006, the entire contents of which are incorporated herein by reference.

FIELD OF THE INVENTION

The present invention relates to a connector for use downhole and to a release and/or retrieval tool for releasing, and/or retrieving the connector from downhole.

BACKGROUND OF THE INVENTION

The use of connectors to join lengths of tubing in oil wells is well known. One particular use of connectors is to connect lengths of tubing together to form a straddle to seal, for example, a perforated zone that is no longer producing hydrocarbons, or a leak in a section of casing.

Conventional modular straddle systems where the straddle is made up of connected sections of tubing, can be difficult to remove from a well as multiple sections or modules may return to surface at the same time and be too large to be removed from the lubricator section.

Accordingly, tube connectors that are releasable and tools that release them and allow them to be retrieved from downhole may be desirable in the art.

BRIEF DESCRIPTION OF THE INVENTION

Disclosed herein relates to a tubing connection release system. The system comprising, a male connector having a profile at one end thereof and receptive to a tubular at one end thereof, a female connector receptive to a tubular at one end thereof and receptive to the male connector at another end thereof. The system further comprising, a sleeve disposed radially inwardly of the female connector, and a collet having at least one deflectable collet finger disposed radially inwardly of the sleeve. The collet being biased to a position within the female connector where at least one collet finger is supported against radially outward deflection. The collet further being urgable by the push-in connector against the bias to a position where at least one collet finger is radially outwardly unsupported such that the profiled end of the male connector is movable into engagement with at least one collet finger.

Further disclosed herein is a device that relates to a release and retrieval tool. The tool comprising, a body, a first collet selectively repositionably attached to the body such that repositioning relative to the body occurs at a first selected load related to a disengagement position of a target engagement. The tool further comprising, a second collet selectively repositionably attached to the body such that repositioning relative to the body occurs at a second selected load related to a disengagement position of a target device subsequent to the disengagement.

Further disclosed herein is a device that relates to a diagnostic shifting tool. The tool comprising, a mandrel having at least one recess therein. The tool further having a collet disposed at the mandrel and positionable on the mandrel to support or unsupport a deflectable finger of the collet with respect to a release arrangement. The release arrangement selectively retaining a portion of the collet relative to the mandrel pending the collet experiencing a load exceeding a load retaining capability of the release arrangement. The load retaining capability being selected to allow release at a load less than a load associated with failure of a target device.

Further disclosed herein is a method for diagnosing a release and retrieval problem. The method comprising, running a release and retrieval tool having a pair of load limited release mechanisms. The method further comprising, engaging a disengagement mechanism in a target device with the tool, attempting to disengage the disengagement mechanism in the target device with the tool, engaging a retrieval feature of the target device with the tool. Subsequently, pulling the tool uphole, and examining the tool release mechanisms for evidence of overload.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of several embodiments of the disclosed apparatus and method are presented herein by way of exemplification and not limitation with reference to the Figures.

Figure 1:
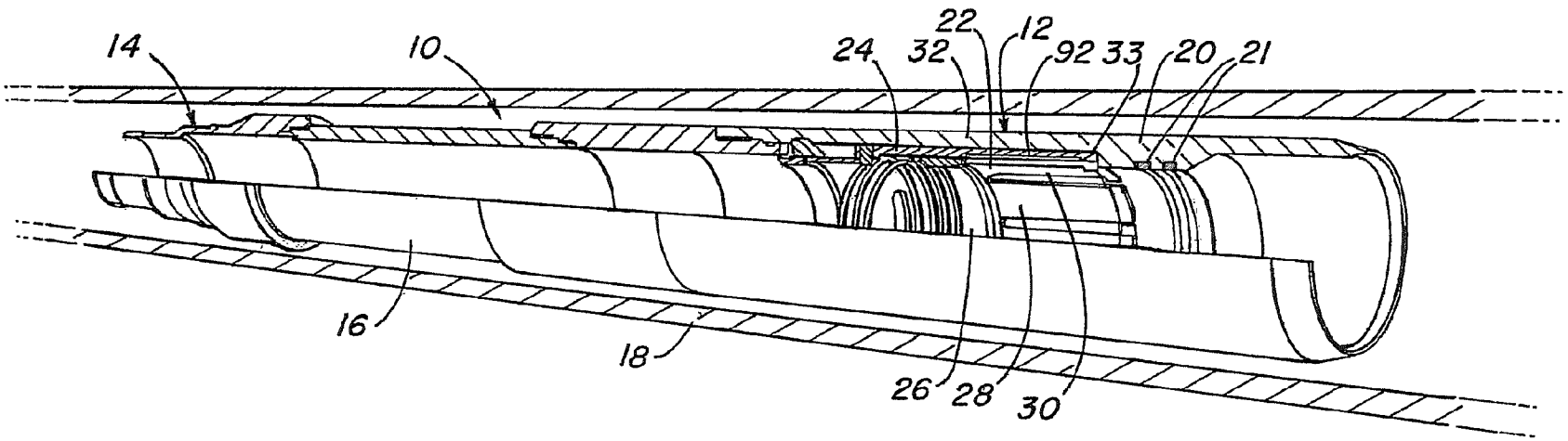
FIG. 1 is a perspective view of a section of tubing section including a female and a male connector portion according to an embodiment of the present invention.

Referring firstly to FIG. 1, there is shown a section of tubing string generally indicted by reference numeral 10 including a female connector portion 12, and a male connector portion 14, according to a first embodiment of the present invention. The tubing string 10 also includes a length of tubing 16 and is shown located inside a cased bore 18.

Figure 2:
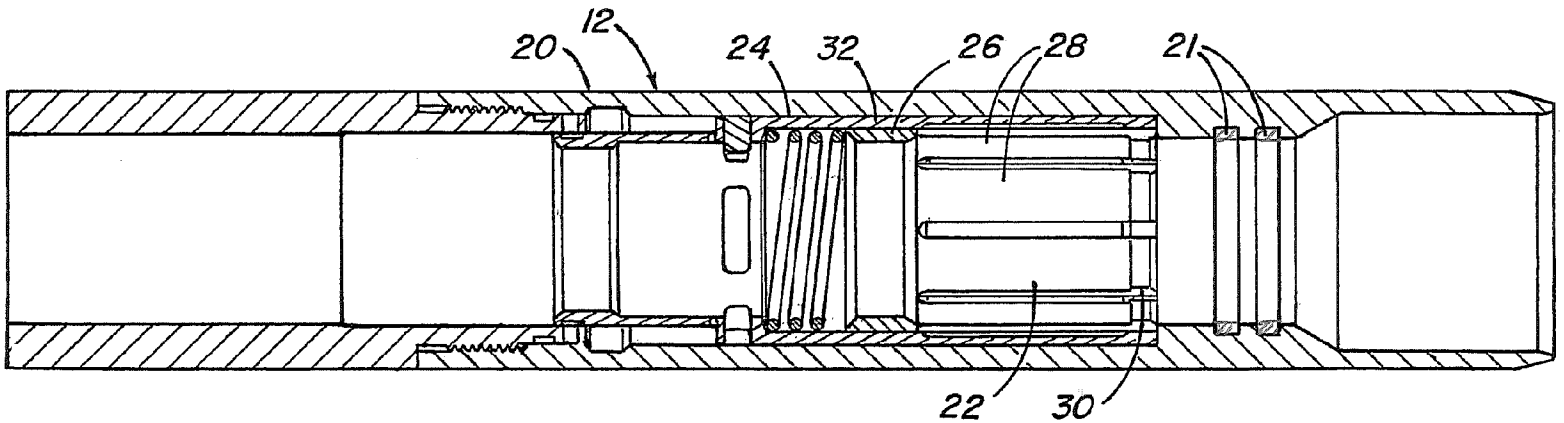
FIG. 2 is a cross-sectional side view of the female connector of FIG. 1.

Referring to FIG. 1 and to FIG. 2, an enlarged cross-sectional side view of the female connector of FIG. 1, the female connector portion comprises a housing 20, a latch 22, and a latch support 24.

The latch 22 is a collet 26, which includes a plurality of collet fingers 28, each collet finger 28 defining a radially inwardly extending profile 30. The profile 30 is adapted to engage a complementary recess defined by an adjacent male connector portion profile (not shown). Also visible are a pair of seals 21, which engage and seal the tubing section 10 to an adjacent tubing section.

The latch support 24 is an axially moveable sleeve 32, having a latch engaging surface 33 and a latch support recess 92.

Figure 3:
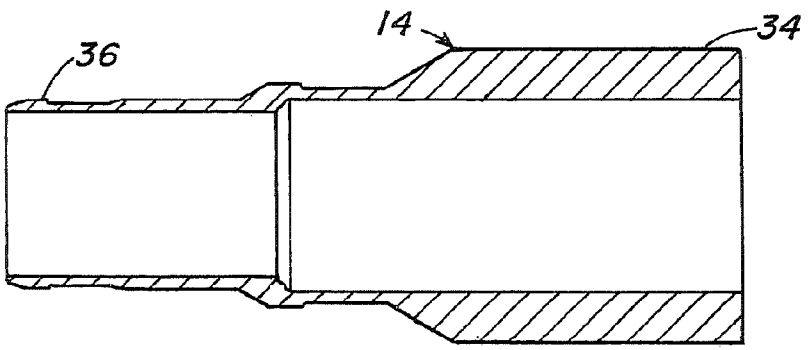
FIG. 3 is a cross-sectional side view of the male connector of FIG. 1.

The male connector portion 14 can be seen in FIG. 3, which is an enlarged cross-sectional side view of the male connector portion 14. The male connector portion 14 comprises a housing 34 defining a raised external profile 36 adapted to engage the collet finger profile 30 of an adjacent female connector portion (not shown).

Figure 4:
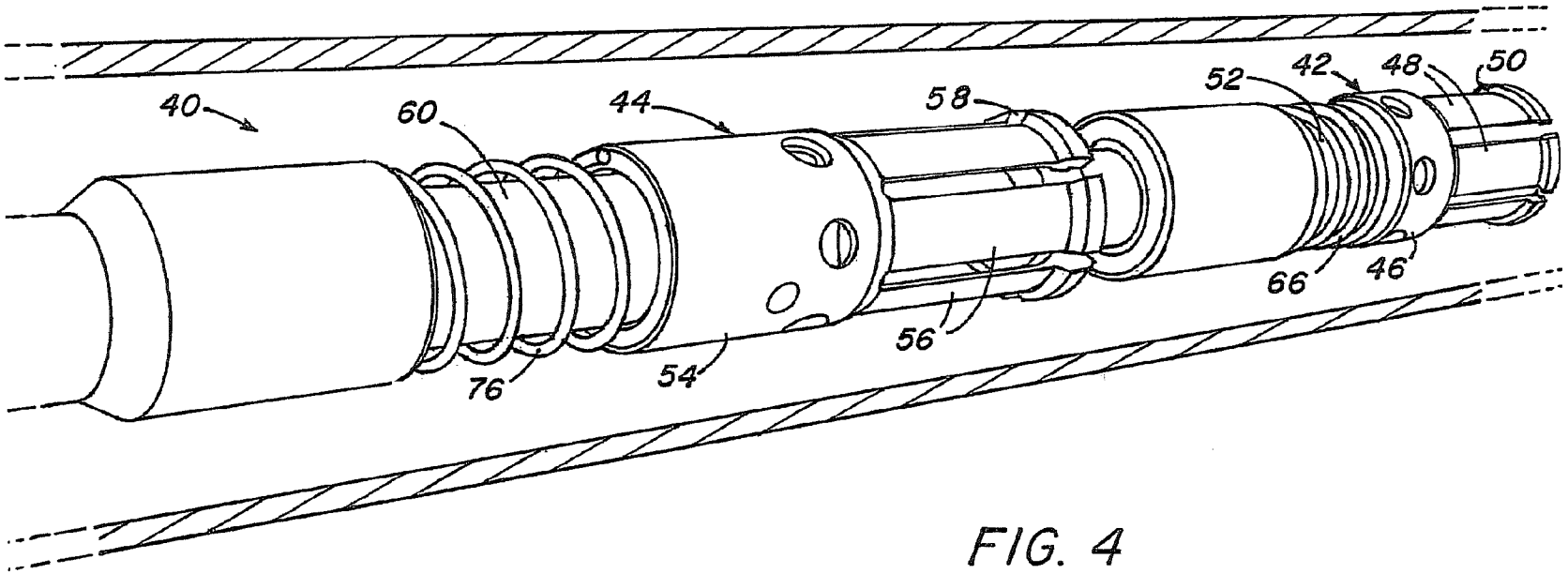
FIG. 4 is a perspective view of a releasing and retrieval tool for releasing and retrieving the section of tubing string of FIG. 1.
Figure 5:
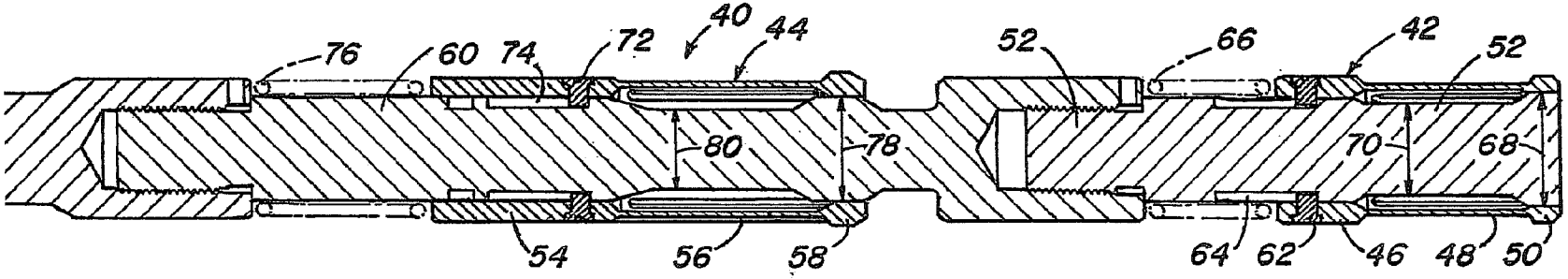
FIG. 5 is a cross-sectional side view of the tool of FIG. 4.

FIG. 4 shows a perspective view of a releasing and retrieving tool 40, for releasing the tubing string 10 from an adjacent tubing string, and retrieving the tubing string 10 to surface. A cross sectional side view of the releasing and retrieving tool 40 is shown in FIG. 5.

The tool 40 comprises a releasing means 42 and a retrieving means 44.

The releasing means 42 is a releasing collet 46 comprising a plurality of collet fingers 48 defining an outwardly extending profile 50. The releasing collet 46 is mounted circumferentially around a lower tool body 52.

The retrieving means 44 is also a collet 54, having fingers 56 defining a radially extending profile 58. The retrieving collet 54 is mounted to an upper tool body 60.

As can be seen from FIG. 5, both collets 46,54 are axially moveable with respect to their respective tool body 52,60. The releasing collet 46 includes a shear screw 62, which is moveable within a slot 64 defined by the lower tool body 52. The releasing collet 46 is biased to the rest position shown in FIG. 5 by means of a spring 66 (shown in broken outline). In this position the releasing collet finger profile 50 is prevented from flexing inwardly by an increased diameter portion 68 of the lower body 52. When the collet 46 is located such that the shear screw 62 is at the other end of the slot 64, the collet fingers 48 can deflect radially inwards into a reduced diameter portion 70 of the lower body 52.

The retrieving collet 54 operates in a similar way, with the shear screw 72 being adapted to slide in slot 74 and the retrieving collet 54 being biased to the rest position shown in FIG. 5 by means of spring 76 (shown in broken outline). The retrieving collet 54 is prevented from flexing inwardly in this rest position by the increased diameter section 78 of the upper body portion 60. When the retrieving collet 54 has moved axially, such that the shear screw 72 is at the other end of the slot 74, the collet fingers 56 can deflect inwardly towards the reduced diameter section 80 of the upper body portion 60.

FIGS. 6 to 15 are a series of cutaway side views of showing a section of the tubing string 10 connecting to an adjacent section of tubing string 82 (FIGS. 6 and 7) and the tubing string 10 being released from the adjacent string 82, retrieved to surface by means of a releasing and retrieving tool 40 (FIGS. 8 to 15).

Figure 6:
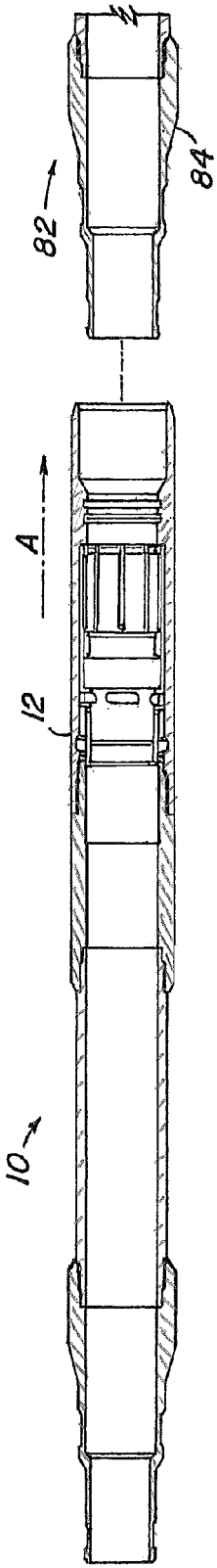
FIG. 6 is a cross-sectional side view of the section of tubing string of FIG. 1 prior to engagement with an adjacent section of tubing string.

FIG. 6 shows the tubing string 10 being moved in the direction of arrow A, that is downhole, towards the adjacent tubing string 82. The female connector portion 12 of the string 10 engages the male connector portion 84 of the adjacent string 82.

Figure 7:
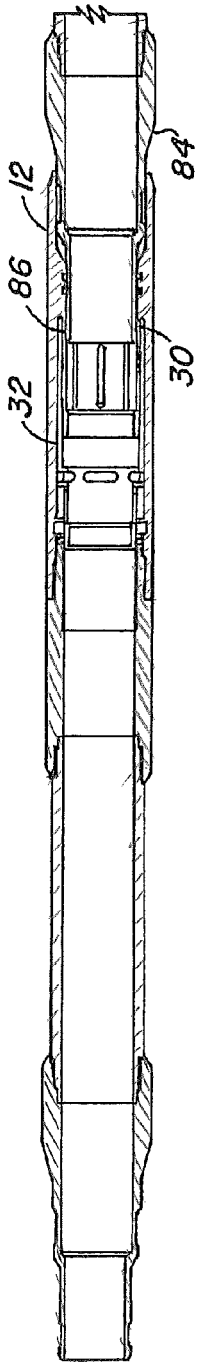
FIG. 7 is a cross-sectional side view of the sections of tubing string of FIG. 6 connected.

As can be seen from FIG. 7, the latch collet finger profile 30 passes over and engages the male connector portion external profile 86. The interim steps of this engagement can be seen more clearly in FIGS. 16 and 17, which will now be described.

Figure 16:
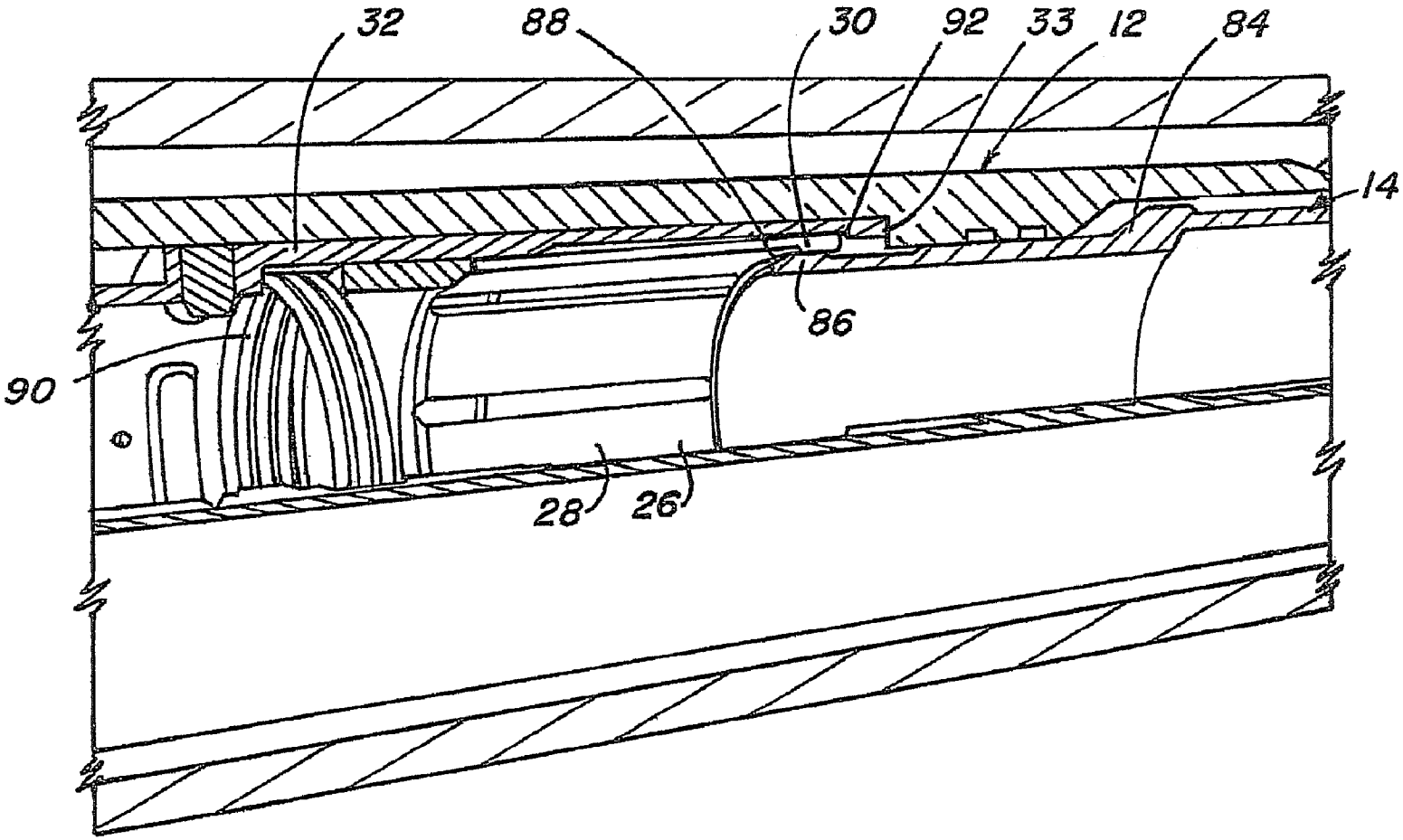
FIG. 16 is an enlarged cut away perspective view of the latch collet passing over the male connector external profile.

FIG. 16 shows a partially cutaway enlarged side view of the female connector portion 12 engaging with the male connector portion 84. As the male connector portion 84 is introduced into the female connector portion 12, the male portion leading edge 88 impacts on the latch profile 30. This impact causes the latch collet 26 to move towards the latch spring 90, depressing the spring 90.

As the latch collet 26 moves, the latch engaging surface 33 on the latch support 26 no longer prevents the profiled end of the collet finger 28 deflecting outwardly. As the force in the spring 90 approaches the force applied by the male connector portion 14, the latch collet 26 will deflect into the recess 92 defined by the latch support sleeve 32. This deflection permits the collet 26 to open up sufficiently to permit the male connector profile 86 to pass the collet finger profile 30.

Figure 17:
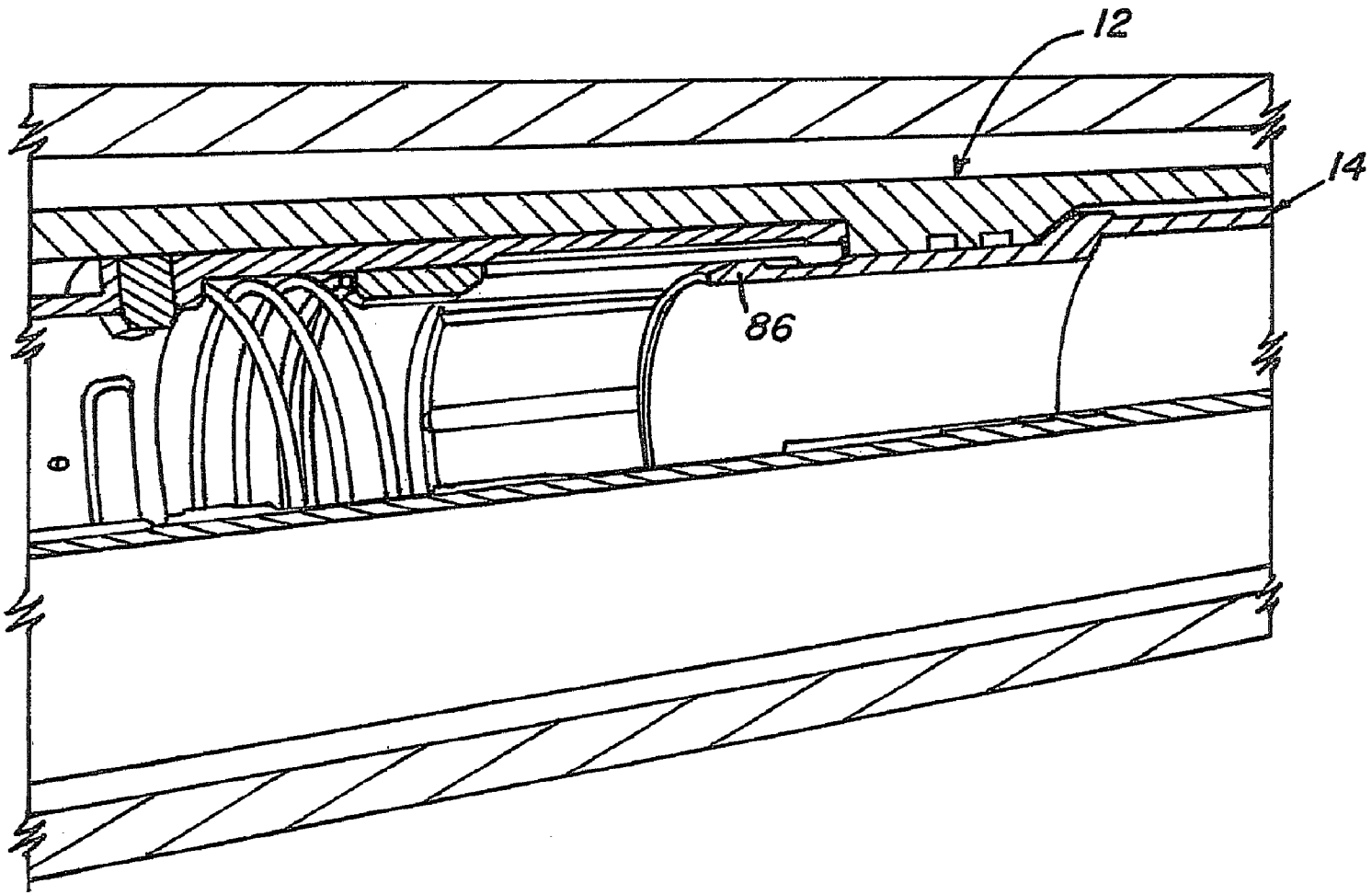
FIG. 17 is an enlarged cut away perspective view of the latch collet secured to the male connector external profile.
Figure 18:
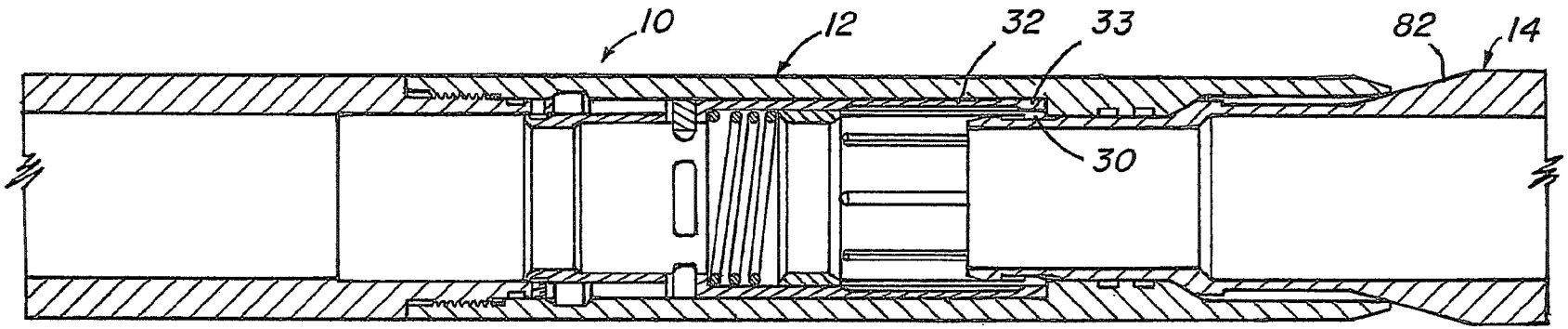
FIG. 18 is a cross-sectional side view of the latch collet secured to the male connector external profile.

Turning now to FIG. 17, once the male connector profile 86 has passed the collet finger profile 30, the spring 90 forces the collet 26 back to the position in which the latch support sleeve 32 prevents deflection of the fingers 28. This is shown in FIG. 18, an enlarged cross-sectional side view of tubing string 10 connected to an adjacent tubing string 82. In this position, the collet finger profile 30 is secured in position by the latch support sleeve 32, particularly by the latch engaging surface 33, preventing the tubing strings 10,82 from being pulled apart.

Figure 8:
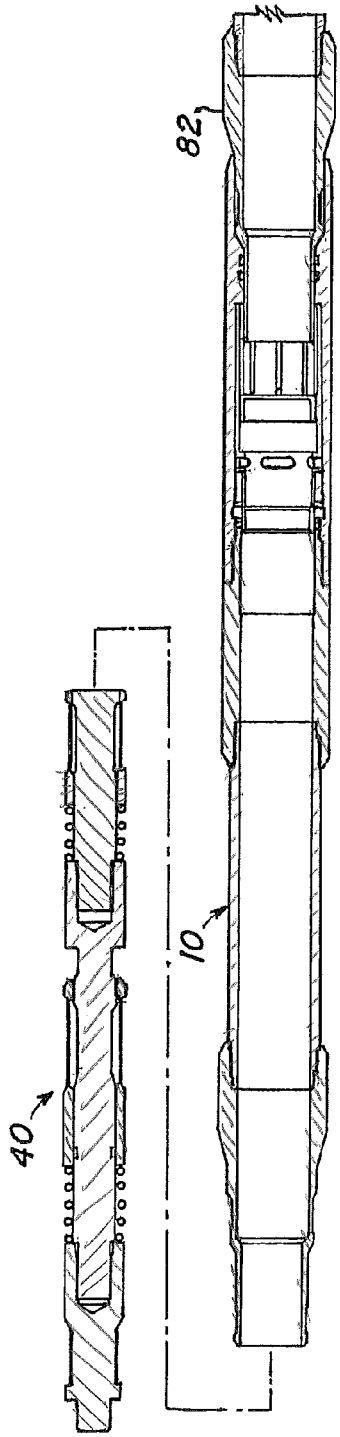
FIG. 8 is a cross-sectional side view of the tool of FIG. 4 prior to entering the connected tubing strings of FIG. 7.
Figure 9:
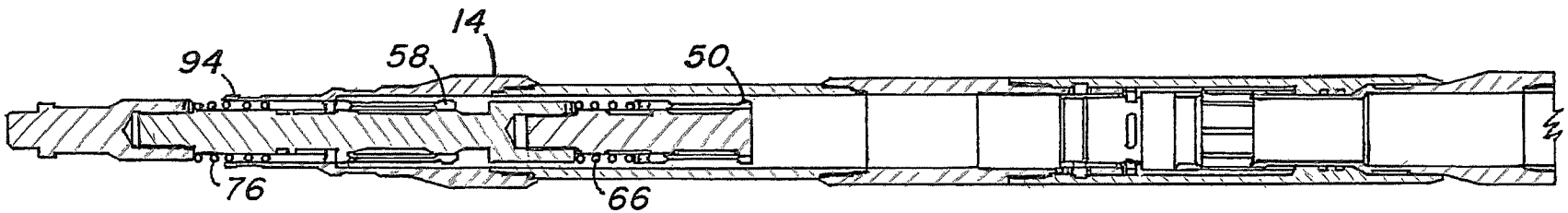
FIG. 9 is a cross-sectional side view of the tool of FIG. 8 partially inserted into the connected sections of tubing string.

Referring now to FIG. 8, this is the first figure in a series showing the release of the tubing string 10 from the tubing string 82 and its retrieval to surface. For this purpose, a releasing and retrieving tool 40 is introduced.

As the tool 40 is introduced (FIG. 9), the releasing collet profile 58 passes through the male connector portion 14 unhindered as the internal diameter of the male connector portion 14 is wider than the external diameter described by the releasing collet profile 50.

Figure 19:
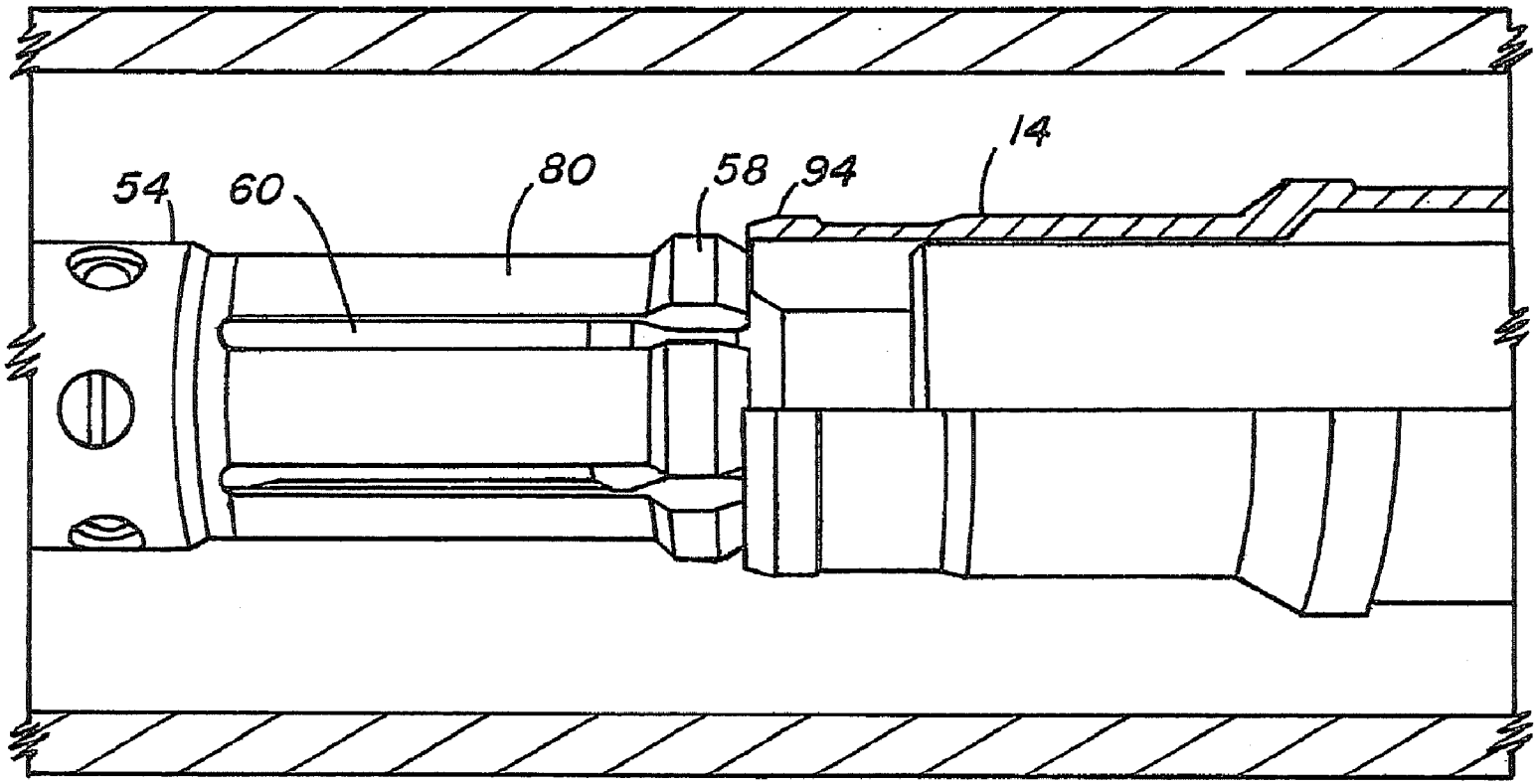
FIG. 19 is an enlarged cut away side view of the retrieving collet prior to engaging the male connector portion inlet section.
Figure 20:
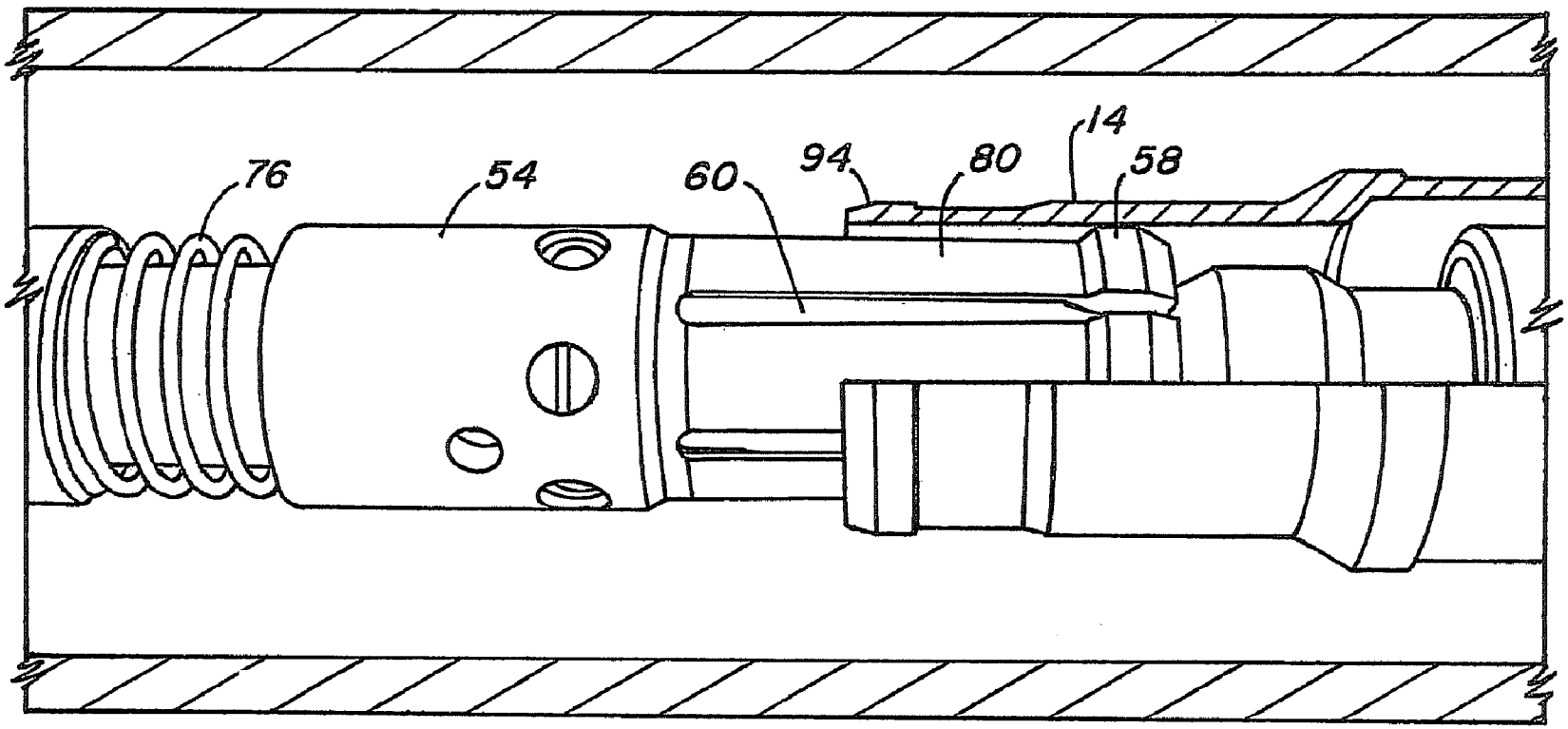
FIG. 20 is an enlarged cut away side view of the retrieving collet passing through the male connector portion inlet section.

The retrieving collet profile 58, however, describes a greater diameter than the diameter described by the inlet portion 94 of the male connector portion 14. FIGS. 19 and 20 are partially cutaway enlarged views showing the retrieving collet 54 entering the male connector portion 14. As the tool 40 passes through the male connector 14, the retrieving collet profile 58 impacts on the male connector inlet portion 94. When this happens, the retrieving collet 54 is forced axially against the spring 76 permitting the retrieving collet fingers 56 to deflect into the reduced diameter region 80 of the upper housing body 60. The axial movement of the retrieving collet 54 is guided by the shear screws 72 sliding in the slot 74. The deflection of the collet fingers 56 causes a reduction in the diameter described by the collet finger profile 58, permitting the retrieving collet to pass through the male connector inlet portion 94.

Figure 10:
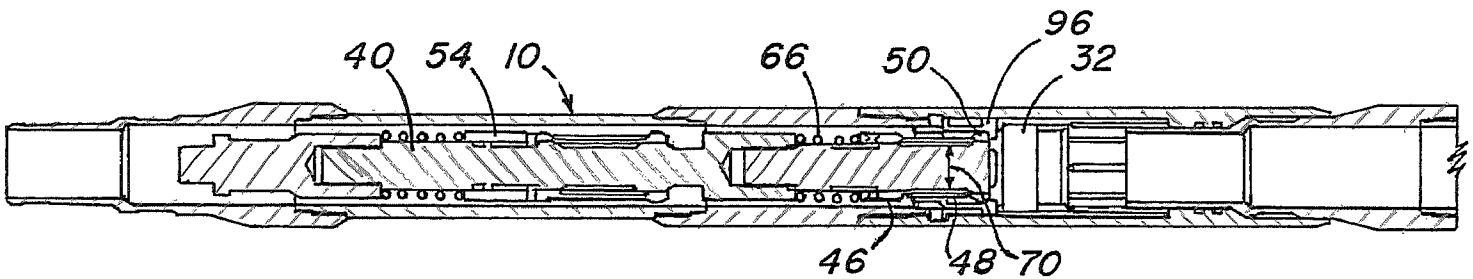
FIG. 10 is a cross-sectional side view of the tool and the connected sections of tubing string particularly showing the tool releasing collet profile engaged with the female connector latch sleeve no-go.

The tool 40 then passes through the tubing string 10 to the position shown in FIG. 10. In this position the releasing collet profile 50 engages a no-go 96 attached to the support sleeve 32. This engagement forces the collet latch 46 against the spring 66 permitting the collet fingers 48 and the profile 50 to deflect into the lower body reduced diameter portion 70, permitting the releasing collet to pass by the no-go 96.

Figure 11:
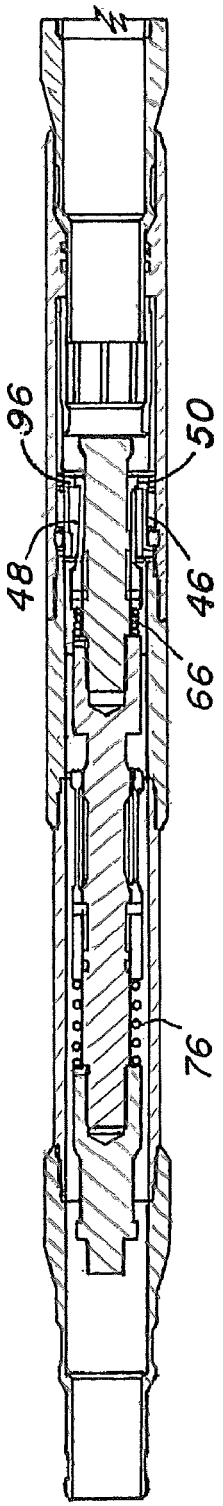
FIG. 11 is a cross-sectional side view of the tool and the connected sections of tubing string particularly showing the tool releasing collet profile passing the female connector latch sleeve no-go.

FIG. 11 shows the collet fingers 48 at their maximum deflection, which occurs as the releasing collet 46 passes the no-go 96. Once the releasing collet profile 50 has passed the no-go 96, the spring 66 recovers the releasing collet 46 to its rest position.

Figure 12:
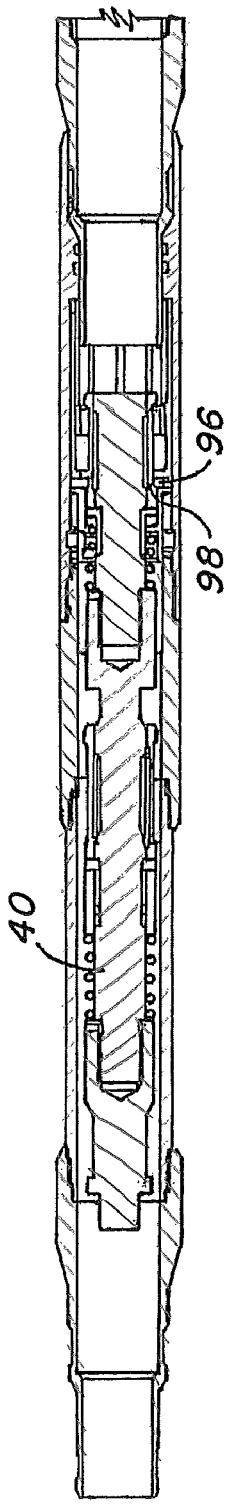
FIG. 12 is a cross-sectional side view of the tool and the connected sections of tubing string particularly showing the tool releasing collet shoulder engaged with the female connector latch sleeve no-go.
Figure 21:
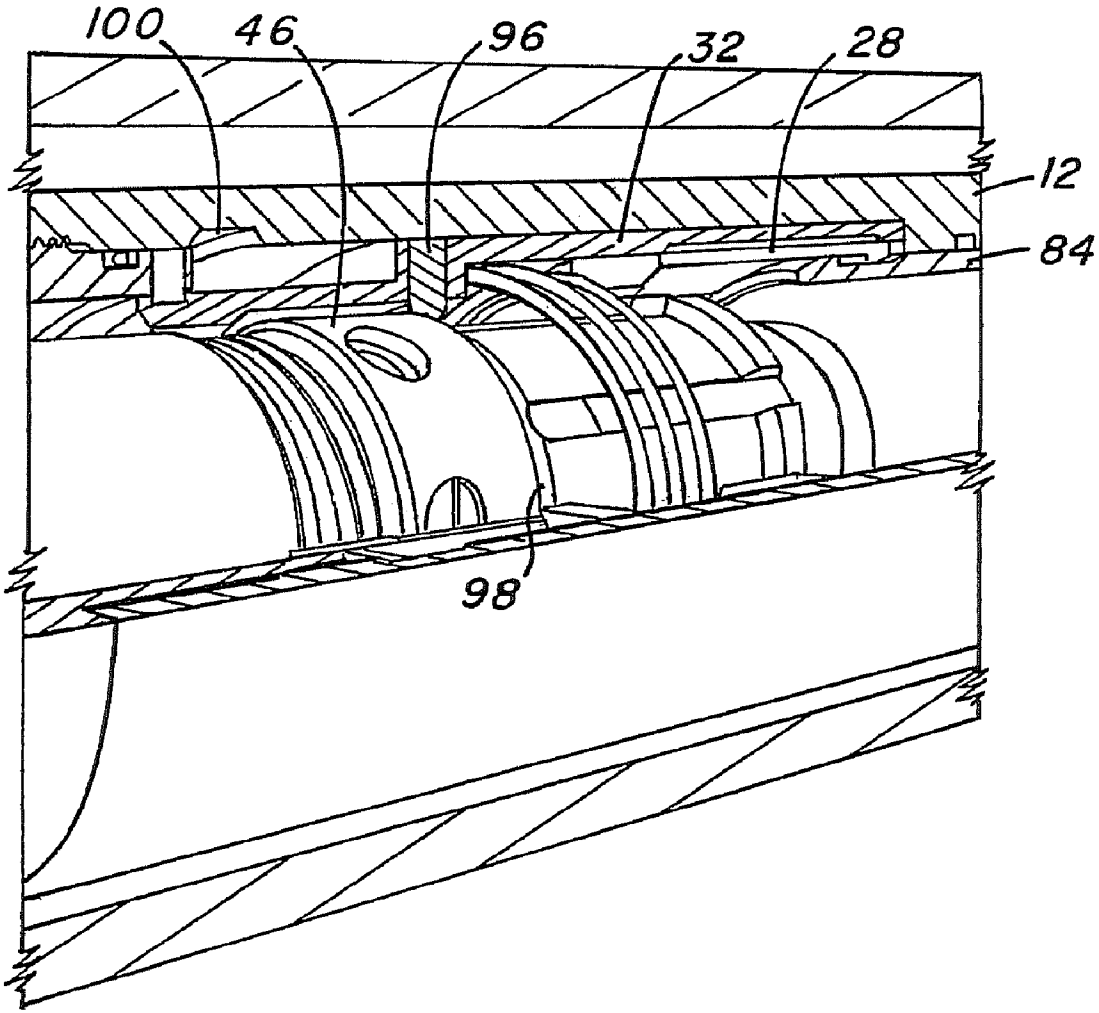
FIG. 21 is an enlarged cut away perspective view of the release collet engaging the latch sleeve no-go.

The tool 40 continues into the female connector portion until the collet shoulder 98 impacts on the no-go 96, as shown in FIG. 12. This can be seen more clearly in FIG. 21, a partially cutaway perspective view of the collet shoulder 98 engaging the latch sleeve no-go 96.

This impact informs an operator at surface that the tool 40 has reached the extent of its travel. As the tool 40 can travel no further through the tubing string 10 only one section of string can be retrieved. This is particularly important if the lubricator section (not shown) at surface can only permit the removal of one section of tubing string 10 at a time.

The direction of the tool 40 can now be reversed, that is the tool 40 is now retrieved towards surface.

Figure 13:
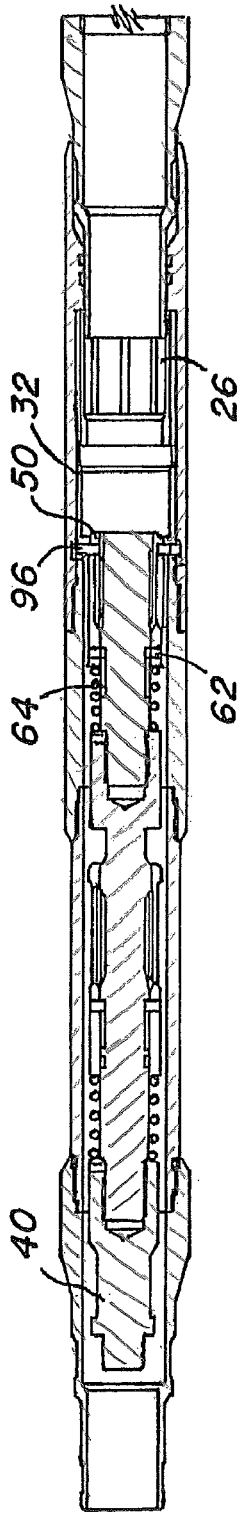
FIG. 13 is a cross-sectional side view of the tool and the connected sections of tubing string particularly showing the tool releasing collet profile engaged with the female connector latch sleeve no-go.
Figure 14:
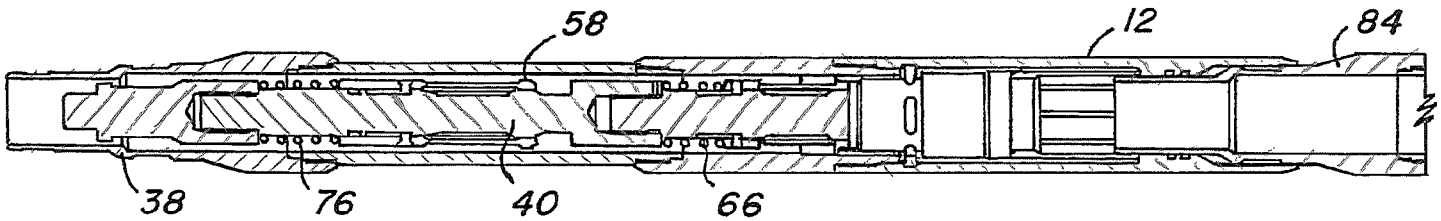
FIG. 14 is a cross-sectional side view of the tool and the connected sections of tubing string particularly showing the tool moving towards the surface having moved the latch sleeve such that the female connector can be pulled away from the adjacent male connector.
Figure 22:
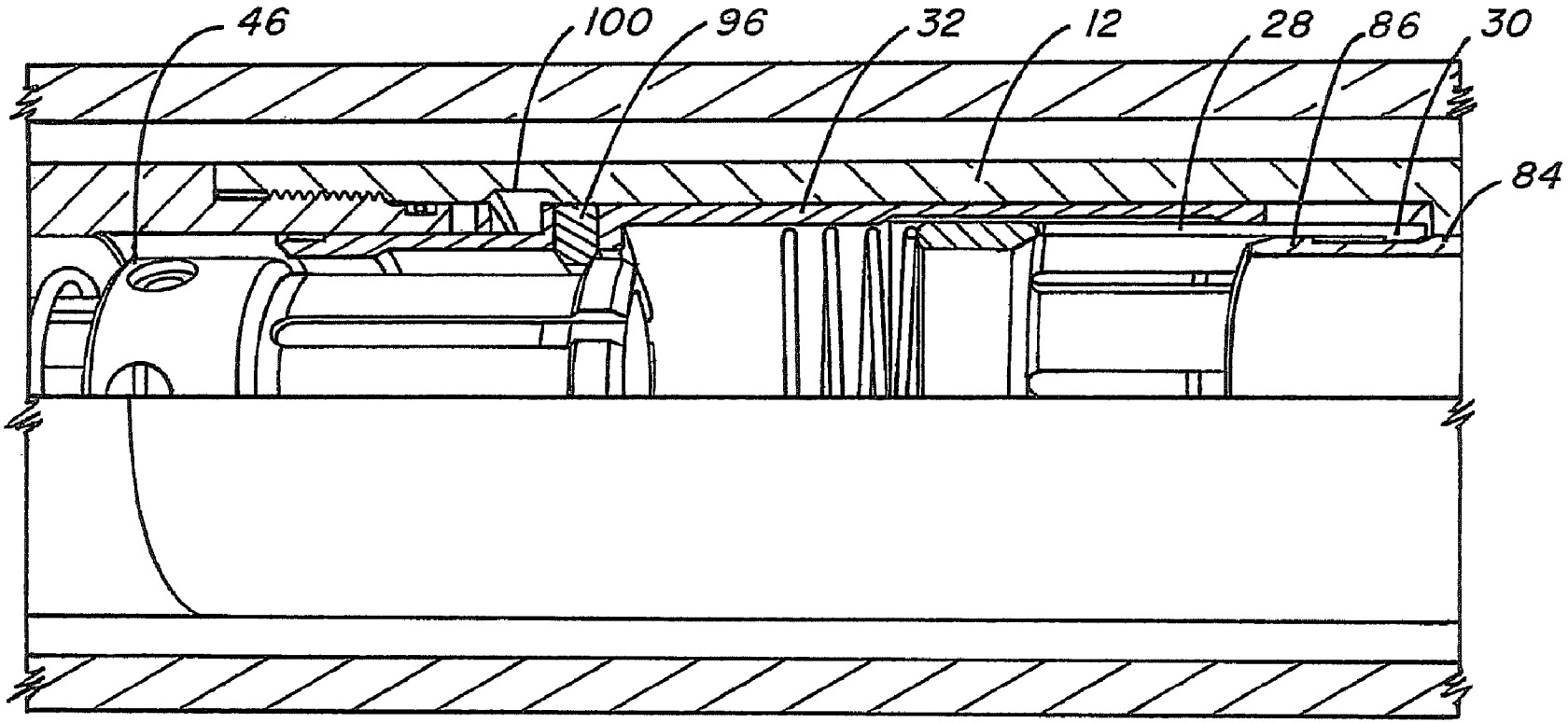
FIG. 22 is an enlarged cut away side view of the release collet profile engaging the latch sleeve no-go.

Turning now to FIG. 13, as the tool 40 is retrieved towards surface, the releasing collet profile 50 engages the no-go 96. As the releasing collet is in its rest position, the shear screws 62 are already at the extreme end of their travel along slot 64. The force applied through the tool will act on the no-go 96 and in turn on the sleeve 32. This force pulls the sleeve 32 to the position shown in FIG. 22, a partially cutaway side view of the releasing collet 46 acting on the no-go 96 to move the latch support sleeve 32.

As the movement of the latch support sleeve 32 continues, the no-go 96 moves towards a housing recess 100. Once the housing recess 100 is reached, the force on the no-go 96 causes the no-go 96 to slide into this recess 100 permitting the retrieval tool 40 to move away from the female connector portion 12. In this position, shown in FIG. 14, the latch support sleeve 32 no longer maintains the collet latch fingers 28, and in particular, the latch profile 30 in contact with the male connector portion 84. Once the retrieving collet 54 starts to pull on the tubing section 10, the latch collet fingers 28 can deflect outwards and pass over the male connector profile 86.

Figure 15:
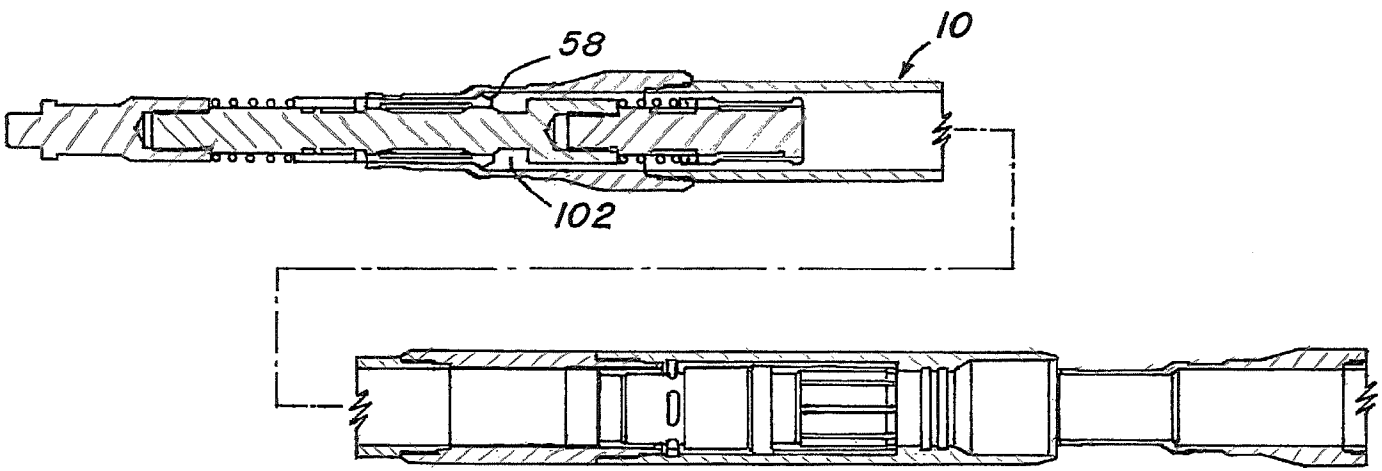
FIG. 15 is a cross-sectional side view of the tool and the connected sections of tubing string particularly showing the retrieving collet engaging the tubing string male connector internal profile permitting the section of tubing string to be recovered.

Referring back to FIGS. 14 and 15, in FIG. 14 the female connector portion 12 has been successfully released from the adjacent male connector portion 84, and the tool 40 is moving through the tubing string 10 to a position where the retrieving collet profile 58 can engage an internal profile 38 defined by the male connector portion 14. As the retrieving collet shear screw 72 is at the maximum extent of its travel within slot 74, the force applied from surface to the retrieving tool 40 will cause the tubing string 10 to lift to surface (as shown in FIG. 15).

If, for whatever reason, the latch support sleeve 32 will not move, the tool 40 is adapted to release from the female connector portion 12 without causing damage to the connector portion 12. This is now described with reference to FIGS. 23 to 25, partially cut away perspective views of the releasing collet 46 passing the latch sleeve no-go 96.

Figure 23:
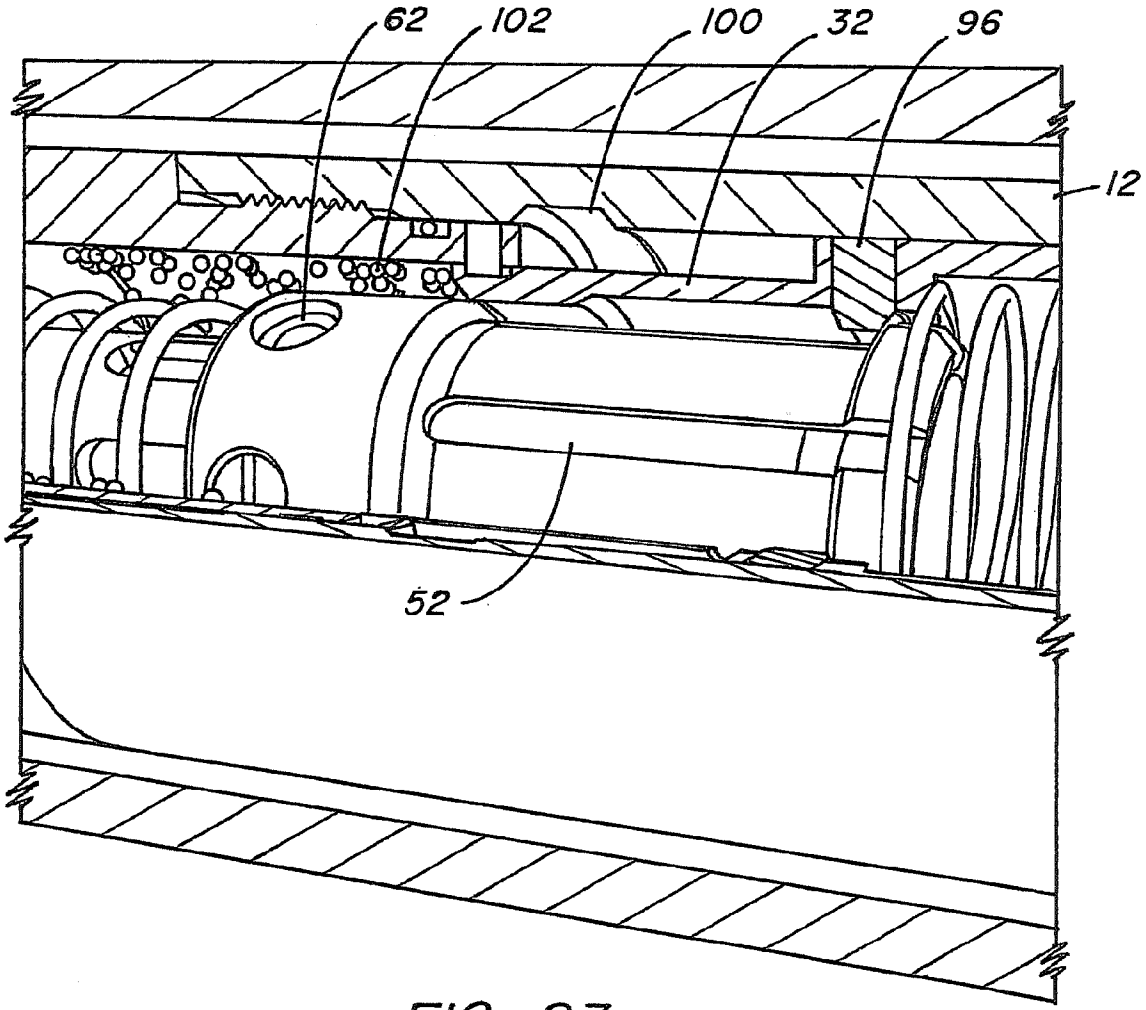
FIG. 23 is an enlarged cut away perspective view of the latch sleeve shown jammed in the secured position by debris.

Referring firstly to FIG. 23, debris 102 has built up behind the support sleeve 32. This debris 102 is preventing the sleeve 32 from moving to a position in which the no-go 96 can enter the recess 100, and permit the tool 40 to vacate the female connector portion 12. In this situation, the pulling (or pushing) force applied to the tool 40 is insufficient to move the sleeve 32. The force increases to a point where the shear screws 62 shear.

Figure 24:
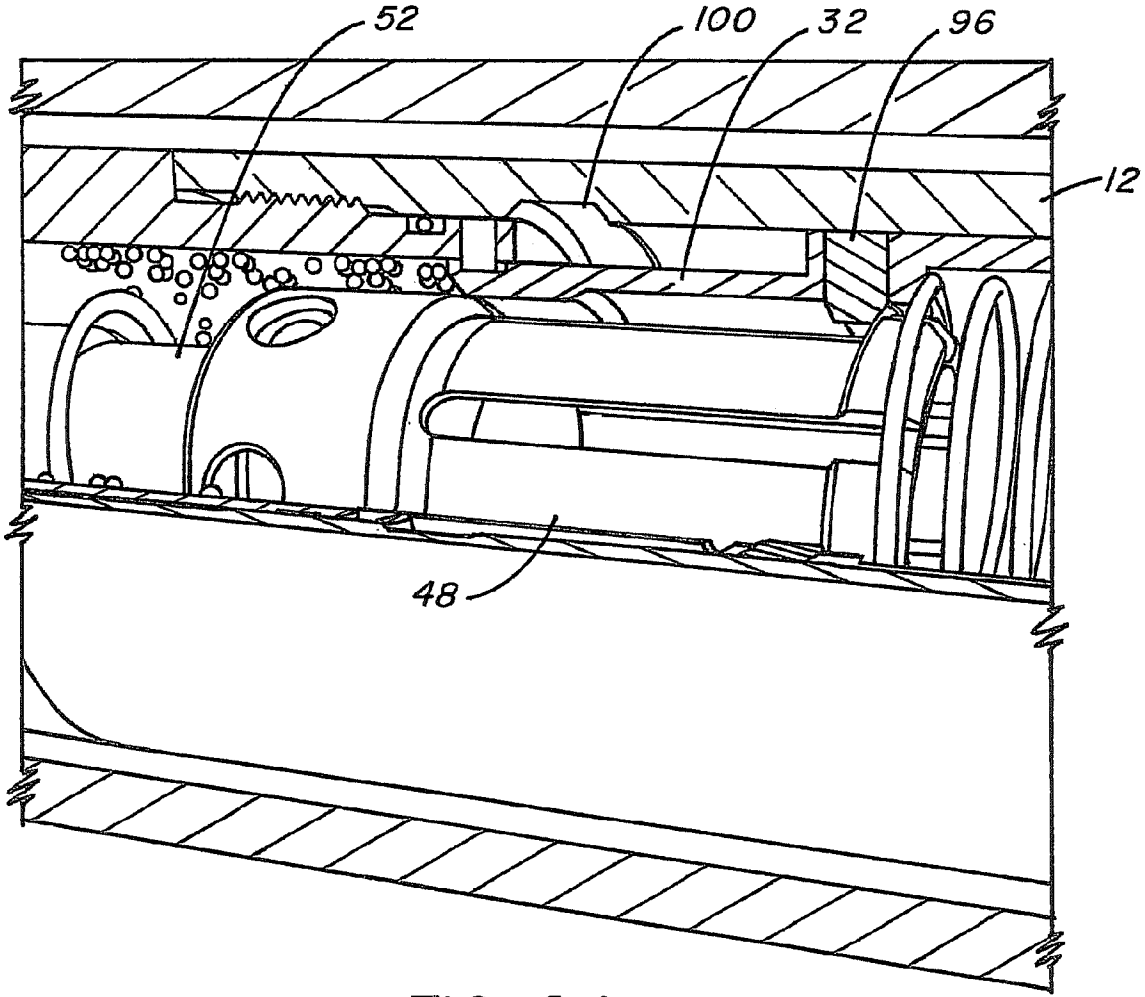
FIG. 24 is an enlarged cut away perspective view of the release collet deflecting to pass the latch sleeve no-go.
Figure 25:
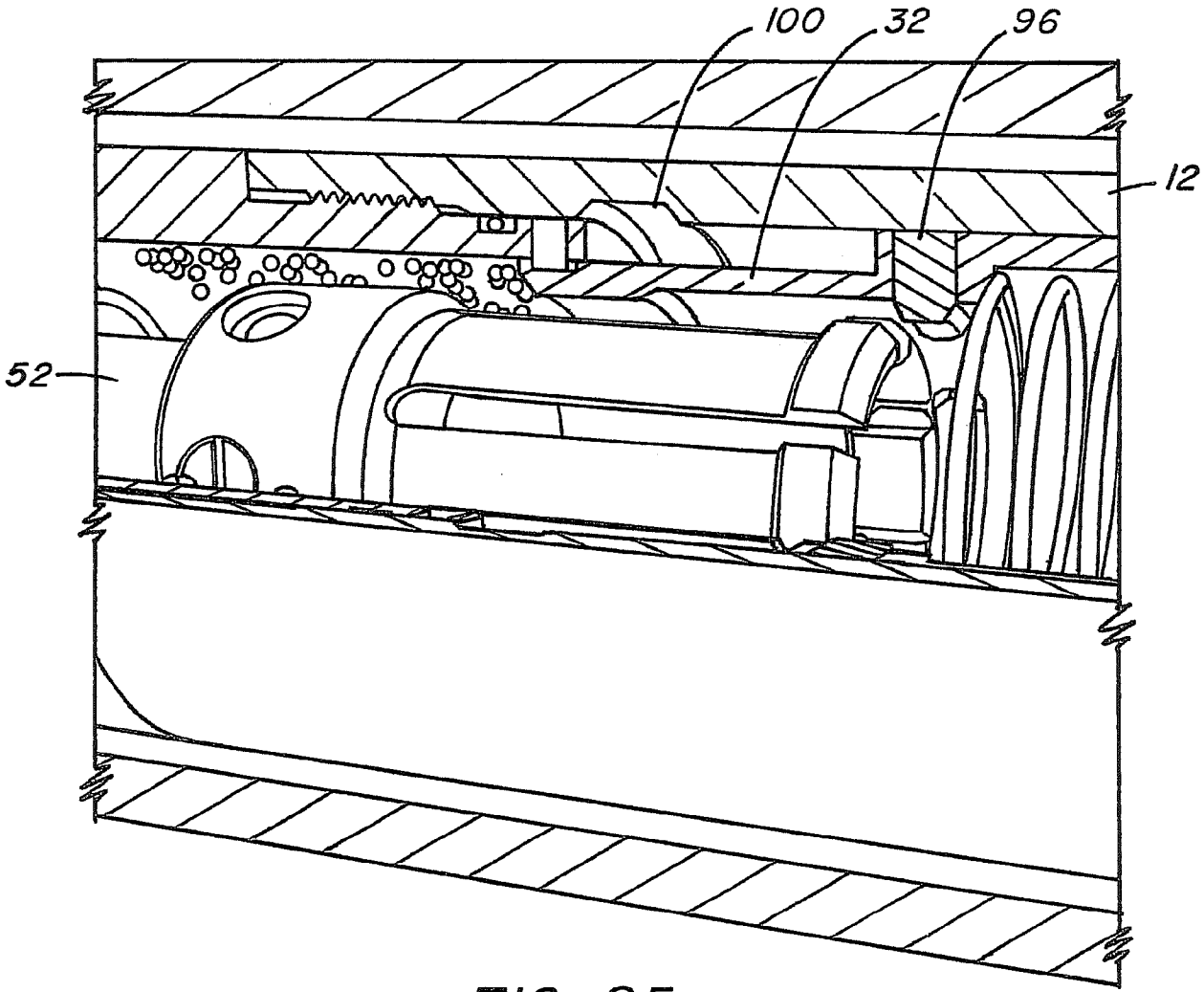
FIG. 25 is an enlarged cut away perspective view of the release collet released from the latch sleeve no-go.

When this happens the lower body portion 52 moves up the tubing string 10 (see FIG. 24). Once the lower body 52 moves with respect to the collet fingers 48, the releasing collet fingers 48 can deflect radially inwards and pass by the no-go 96 (FIG. 25). When the tool 40 is finally recovered to surface, an operator would note that the releasing collet shear screws 62 have been sheared, indicating that the problem with retrieving the tubing string 10 lies in the releasing of the female connector portion 12 from the adjacent male connector portion 84.

If the tubing string 10 is stuck, for example, because the female connector 12 portion has not been released from the male connector portion 84, or if the tubing string 10 is jammed in the case for some other reason, the shear screw 72 will shear, and the upper tool body 60 will move with respect to the retrieving collet 54 towards surface. The retrieving collet fingers 56 can then deflect towards a reduced tool body diameter 70 permitting the retrieving collet 54 to pass the internal profile 38, and allow the retrieving tool 40 to be recovered to surface.

In this situation an operator can inspect the tool 40, and diagnose why the tubing string 10 has not been recovered to surface. If the releasing collet 46 is intact, and the retrieving collet 54 is sheared, then the tubing string 10 has been released from the adjacent string 82, but it has become stuck or jammed in the casing. If both collets 46,54 are sheared, then the releasing collet 46 has failed to release the female connector portion 12 from the male connector portion 84 of the adjacent string 82.

Various modifications may be made to the described embodiment without departing from the scope of the invention. For example, it will be understood that the releasing and retrieving tool could engage a profile on the female connector to recover the section of tubing string to surface.

Those of skill in the art will recognize that the above-described embodiment of the invention provides a connector that can be separated by an internal release mechanism.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed:

1. A release and retrieval tool, comprising:

a body;

a first collet selectively repositionably attached to the body such that repositioning relative to the body occurs at a first selected load related to disengagement of a target engagement; and a second collet selectively repositionably attached to the body such that repositioning relative to the body occurs at a second selected load related to disengagement of a target device.

2. The release and retrieval tool of claim 1, wherein the first selected load is set to be less than a load related to failure of the target device.

3. The release and retrieval tool of claim 1, wherein the first collet includes a release mechanism having stability at loads less than the first selected load.

4. The release and retrieval tool of claim 1, wherein the first selected load is a tensile load.

5. The release and retrieval tool of claim 3, wherein the release mechanism is a shear mechanism.

6. The release and retrieval tool of claim 5, wherein the shear mechanism is a shear screw.

7. The release and retrieval tool of claim 3, wherein at least one finger of the first collet is unsupported radially by the body subsequent to release of the release mechanism such that the at least one finger is radially collapsible and thereby disengagable from the target device.

8. The release and retrieval tool of claim 1, wherein the second selected load is set to be less than a load related failure of the target device.

9. The release and retrieval tool of claim 1, wherein the second collet includes a release mechanism having stability at loads less than the second selected load.

10. The release and retrieval tool of claim 1, wherein the second selected load is a tensile load.

11. The release and retrieval tool of claim 9, wherein the release mechanism is a shear mechanism.

12. The release and retrieval tool of claim 11, wherein the shear mechanism is a shear screw.

13. The release and retrieval tool of claim 9, wherein at least one finger of the second collet is unsupported radially by the body subsequent to release of the release mechanism such that the at least one finger is radially collapsible and thereby disengagable from the target device.

14. The release and retrieval tool of claim 1, wherein the first collet is longitudinally slidable and biased relative to the body to a position wherein the body supports at least one finger on the first collet from radially inward deflection.

15. The release and retrieval tool of claim 1, wherein the second collet is longitudinally slidable and biased relative to the body to a position wherein the body supports at least one finger on the second collet from radially inward deflection.

* * * * *